US012698643B2

(12) United States Patent
Long

(10) Patent No.: US 12,698,643 B2
(45) Date of Patent: Aug. 4, 2026

(54) FENCE PANEL AND FENCE

(71) Applicant: Guangzhou Mibo Zhilian Technology Co. LTD., Guangzhou (CN)

(72) Inventor: Ziyi Long, Beijing (CN)

(73) Assignee: Guangzhou Mibo Zhilian Technology Co. LTD., Guangzhou (CN)

( * ) Notice: Subject to any disclaimer, the term of this patent is extended or adjusted under 35 U.S.C. 154(b) by 0 days.

(21) Appl. No.: 19/317,207

(22) Filed: Sep. 3, 2025

(65) Prior Publication Data

US 2026/0210153 A1 Jul. 23, 2026

(51) Int. Cl.
*E04H 17/18* (2006.01)
*E04H 17/16* (2006.01)

(52) U.S. Cl.
CPC ..... *E04H 17/165* (2013.01); *E04H 17/18* (2013.01)

(58) Field of Classification Search
CPC ..... E04B 2/7431; E04B 1/585; E04H 15/006; E04H 15/008; E04H 17/165; E04H 17/18; G09F 17/00; G09F 15/0025
See application file for complete search history.

(56) References Cited

U.S. PATENT DOCUMENTS 2,839,320 A * 6/1958 Hill ..... F16B 7/0486 D8/382
4,558,968 A * 12/1985 Meickl ..... E04B 1/2604 403/255
5,722,477 A * 3/1998 Richter ..... F16B 7/04 403/231
6,370,803 B1 * 4/2002 Burquest ..... G09F 17/00 40/607.1
7,866,074 B2 * 1/2011 McComb ..... B43L 1/045 40/606.01
9,551,921 B2 * 1/2017 Redmon ..... G03B 21/58
10,327,545 B2 * 6/2019 McPhillips ..... A47B 47/0091
10,473,260 B2 * 11/2019 McPhillips ..... F16M 11/041
2013/0259563 A1 * 10/2013 Campbell ..... E04B 1/2604 403/188
2014/0197123 A1 * 7/2014 McPhillips ..... G09F 15/00 211/195
2017/0096836 A1 * 4/2017 Ritter ..... E01F 13/022
2021/0207363 A1 * 7/2021 Bucklitsch ..... E04B 1/541
2023/0358031 A1 * 11/2023 Park ..... E04B 1/34326
2023/0366195 A1 * 11/2023 Park ..... E04B 1/34315
2023/0399837 A1 * 12/2023 Rutten ..... E04B 1/2604

* cited by examiner

*Primary Examiner* — Daniel J Wiley
(74) *Attorney, Agent, or Firm* — Jose Cherson Weissbrot

(57) ABSTRACT

The present disclosure relates to a fence panel and a fence. The fence panel includes a frame, a first fastener, a second fastener and a supporting foot, where the frame includes a longitudinal tube; the first fastener is disposed at an end of the longitudinal tube; the supporting foot includes a supporting end and a connecting end that are oppositely arranged, where the supporting end is configured for contacting with a floor, and the connecting end is inserted into the end of the longitudinal tube provided with the first fastener; and the supporting foot is internally provided with a through hole running through the supporting end and the connecting end, and the second fastener is securely connected to the first fastener by passing through the through hole in a direction from the supporting end to the connecting end, thereby mounting the supporting foot to the longitudinal tube.

12 Claims, 5 Drawing Sheets

FENCE PANEL AND FENCE

TECHNICAL FIELD

The present disclosure relates to the field of fences, and in particular to a fence panel and a fence.

BACKGROUND

Acrylic metal fences are widely applied in household, pet and commercial scenarios, and are used for various purposes, such as area isolation, protection and decoration. These metal fences are typically composed of metal frames and transparent acrylic face plates, and have good aesthetic appearance and strength. Since an acrylic material has the characteristics of having high transparency and being durable and non-fragile, the acrylic metal fences have a wide range of applications in terms of safety and visual effect in combination with the robustness of the metal frames.

SUMMARY

The present disclosure provides a fence panel, which includes:

a frame including a longitudinal tube;

a first fastener disposed at an end of the longitudinal tube;

a second fastener; and a supporting foot including a supporting end and a connecting end that are oppositely arranged, the supporting end being configured for contacting with a floor, and the connecting end being inserted into the end of the longitudinal tube provided with the first fastener; where the supporting foot is internally provided with a through hole running through the supporting end and the connecting end, and the second fastener is securely connected to the first fastener by passing through the through hole in a direction from the supporting end to the connecting end, thereby mounting the supporting foot to the longitudinal tube.

The present disclosure further provides a fence, which includes a plurality of fence panels, adjacent fence panels being connected in an articulated manner; where the fence panel includes:

a frame including a longitudinal tube;

a first fastener disposed at an end of the longitudinal tube;

a second fastener; and a supporting foot including a supporting end and a connecting end that are oppositely arranged, the supporting end being configured for contacting with a floor, and the connecting end being inserted into the end of the longitudinal tube provided with the first fastener; where the supporting foot is internally provided with a through hole running through the supporting end and the connecting end, and the second fastener is securely connected to the first fastener by passing through the through hole in a direction from the supporting end to the connecting end, thereby mounting the supporting foot to the longitudinal tube.

BRIEF DESCRIPTION OF THE DRAWINGS

In accompanying drawings, the same reference signs denote the same or similar components or elements throughout multiple drawings unless otherwise specified. These drawings are not necessarily drawn to scale. It should be understood that these drawings depict only some implementations according to the present disclosure and should not be construed as limiting the scope of the present disclosure.

LIST OF REFERENCE SIGNS

Figure 1:
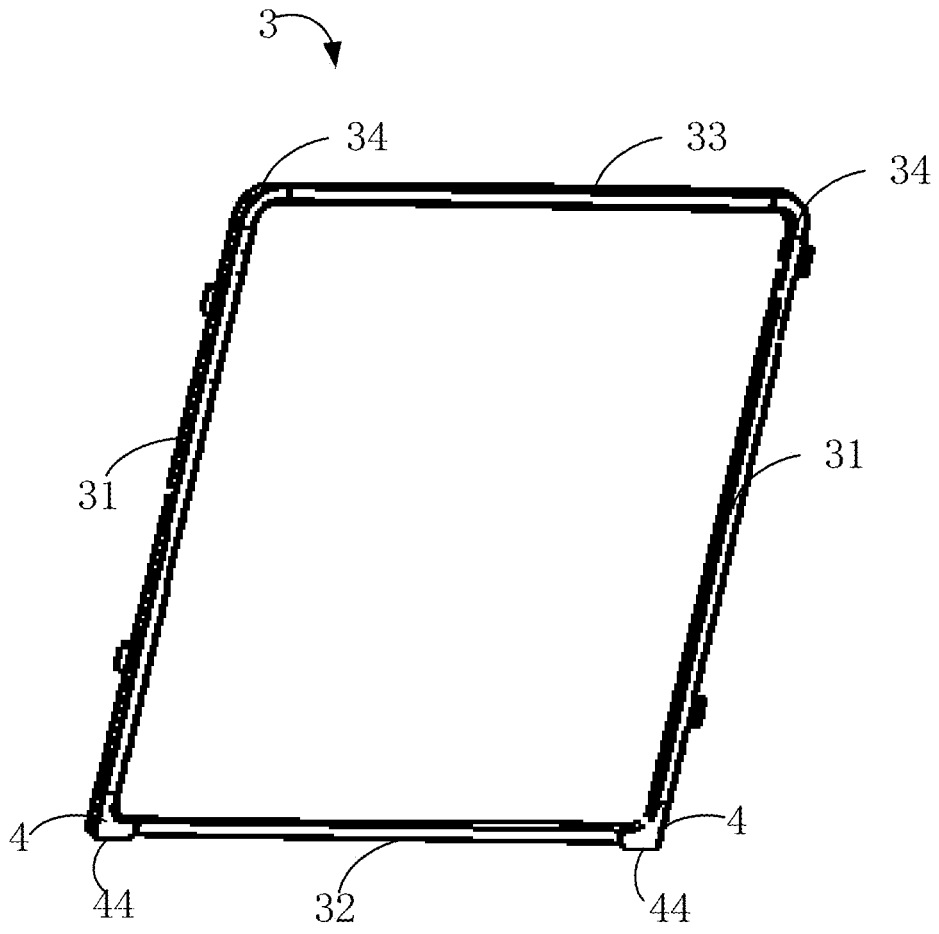
FIG. 1 is a schematic structural perspective view of a fence panel according to an embodiment of the present disclosure.

100. Fence panel; 1. First fastener; 11. Inner wall; 2. Second fastener; 3. Frame; 31. Longitudinal tube; 32. Bottom transverse tube; 322. Catch slot; 33. Top transverse tube; 34. Connecting member; 35. Elongated groove; 4. Supporting foot; 41. Supporting end; 42. Connecting end; 43. Snap-in post; 44. Anti-slip pad; 45. Through hole; 46. Arc-shaped groove; 5. Face plate.

DETAILED DESCRIPTION OF EMBODIMENTS

Only some exemplary embodiments are briefly described below. As can be appreciated by those skilled in the art, modifications may be made to the described embodiments in various ways without departing from the spirit or scope of the present disclosure. Therefore, the accompanying drawings and the description are considered as exemplary in nature rather than limiting.

Referring to FIGS. 1 to 4, the present disclosure provides a fence panel 100, which includes a frame 3, a first fastener 1, a second fastener 2 and a supporting foot 4, where the frame 3 includes a longitudinal tube 31, and the first fastener 1 is disposed at an end of the longitudinal tube 31. The supporting foot 4 includes a supporting end 41 and a connecting end 42 that are oppositely arranged, where the supporting end 41 is configured for contacting with a floor, and the connecting end 42 is inserted into the end of the longitudinal tube 31 provided with the first fastener 1; and the supporting foot 4 is internally provided with a through hole 45 running through the supporting end 41 and the connecting end 42, and the second fastener 2 is securely connected to the first fastener 1 by passing through the through hole 45 in the supporting end 41 and the connecting end 42 in sequence, thereby mounting the supporting foot 4 to the longitudinal tube 31.

As the first fastener 1 is disposed in the longitudinal tube 31 and then the second fastener 2 is securely connected to the first fastener 1 by passing through the supporting foot 4, a better effect of securing the supporting foot 4 and the longitudinal tube 31 is achieved, and the frame 3 is firmly secured to the supporting feet 4; moreover, mounting steps are simple and easy for a user to operate.

With reference to FIGS. 1 to 4, specifically, the first fastener 1 is embedded into the longitudinal tube 31, an inner wall 11 of the first fastener 1 is provided with a thread mating with the second fastener 2, the second fastener 2 is a screw, and the screw engages with the thread. The first fastener 1 is embedded into the longitudinal tube 31, so that the first fastener 1 can be protected from being affected by an external environment, and the appearance tidiness can also be improved. This screw and thread design is easy for the user to mount the supporting foot 4 to the frame 3, the operation is simple and easy, and a good securing effect can also be achieved. A nut can be embedded into the first fastener 1 to be in secure fit with the second fastener 2.

In another embodiment, the inner wall 11 of the first fastener 1 is provided with a snap-fit part, the second fastener 2 is a snap-fit part corresponding to the snap-fit part on the inner wall 11 of the first fastener 1, and the first fastener 1 and the second fastener 2 are secured together in a snap-fit manner. This snap-fit design is easy for the user to mount the supporting foot 4 to the frame 3, the operation is simple and easy, and a good securing effect can also be achieved.

In one of the embodiments, the first fastener 1 may be secured in the longitudinal tube 31 by means of the snap-fit part, or the first fastener 1 may be nailed in the longitudinal tube 31 by means of a nail.

With reference to FIGS. 3 to 6, in one of the embodiments, the frame 3 further includes a bottom transverse tube 32, and catch slots 322 are formed in two ends of the bottom transverse tube 32 respectively. The supporting foot 4 further includes a snap-in post 43, and the snap-in post 43 is inserted in the catch slot 322 and configured to secure one of the supporting feet 4 to each of the two ends of the bottom transverse tube 32. The snap-in post 43 is embedded into the catch slot 322, and the snap-in post and the catch slot are connected in a snap-fit manner, thereby achieving simple mounting and stable embedding, and effectively solving the problem of misalignment or looseness. The snap-in post 43 and the catch slot 322 are further secured by means of a fixing pin.

With reference to FIGS. 3 to 6, in one of the embodiments, the frame 3 further includes a top transverse tube 33, the top transverse tube 33 and the bottom transverse tube 32 are oppositely arranged vertically, one end of the top transverse tube 33 is connected to the corresponding end of the bottom transverse tube 32 by means of one of the longitudinal tubes 31, and the other end of the top transverse tube 33 is connected to the corresponding other end of the bottom transverse tube 32 by means of the other of the longitudinal tubes 31. In this way, one top transverse tube 33, one bottom transverse tube 32 and two longitudinal tubes 31 form the rectangular frame 3 in an enclosure manner. Specifically, the fence panel further includes a face plate 5 embedded into the frame 3. The bottom transverse tube 32, the top transverse tube 33 and the longitudinal tube 31 are each provided with an elongated groove 35 in respective length directions, the elongated groove 35 is formed as a rectangular elongated receiving space, and each edge of the face plate 5 is inserted into the corresponding elongated groove 35 such that the face plate 5 is inserted into the frame 3. Such a design allows the face plate 5 to be stably snapped into the frame 3 and is less prone to detachment. An effect of securing the face plate 5 on the frame 3 can be improved by adding rubber strips or snap-fit parts as required. The supporting foot 4 is further provided with an arc-shaped groove 46 in correspondence with the face plate 5, which is configured for the insertion of a corner edge of the face plate 5 in order to more stably secure the face plate 5 in the frame 3.

Figure 2:
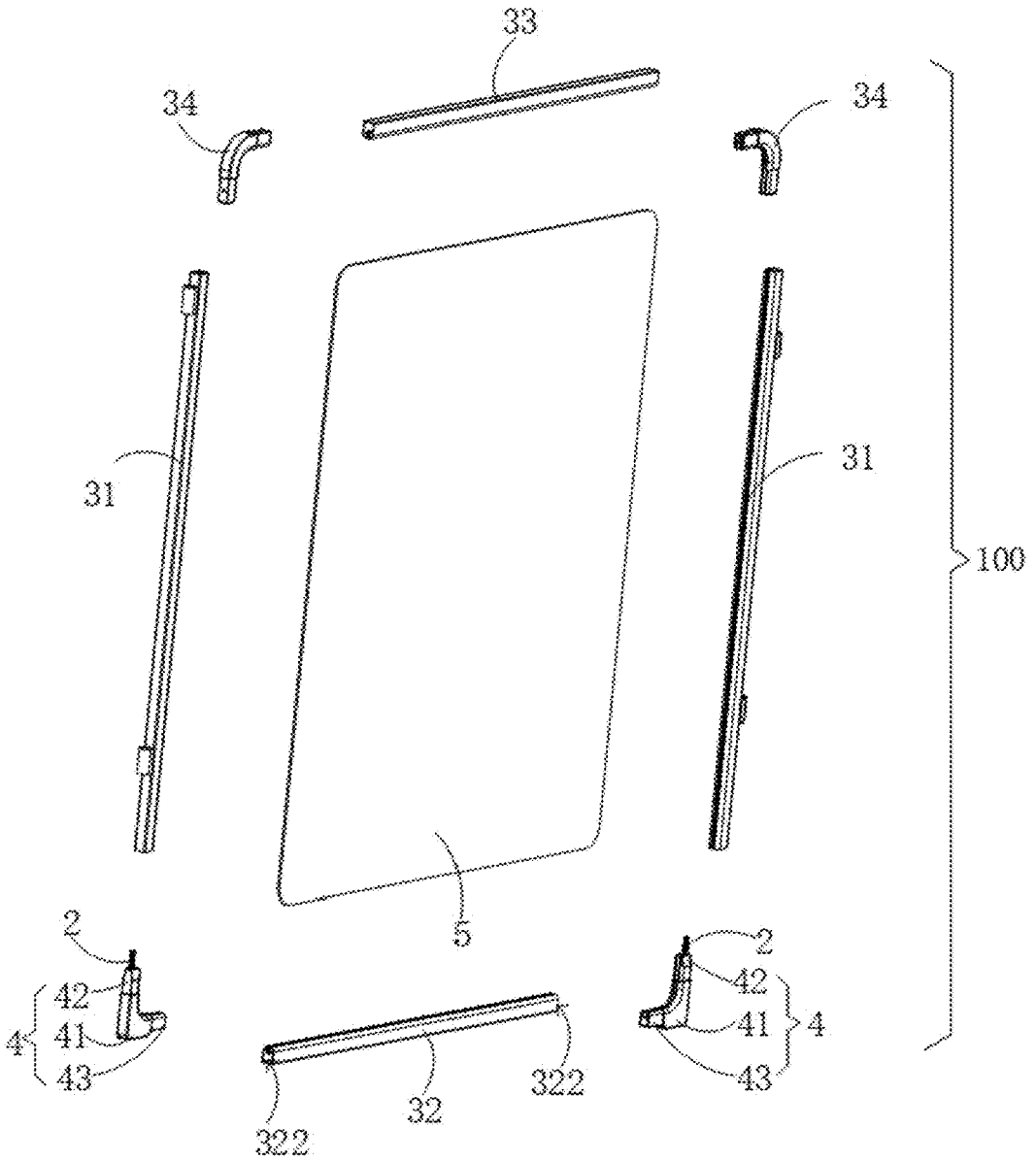
FIG. 2 is a schematic structural exploded view of a fence panel according to an embodiment of the present disclosure.
Figure 3:
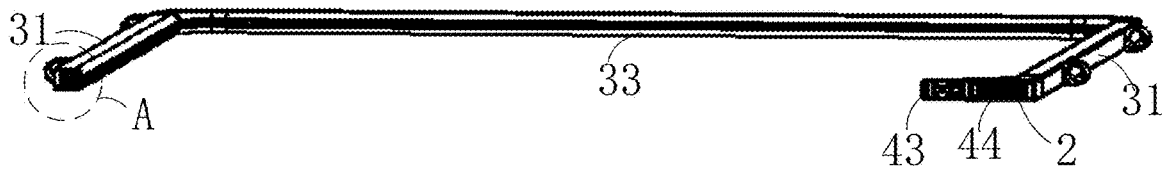
FIG. 3 is a schematic structural diagram of a frame without a bottom transverse tube according to an embodiment of the present disclosure.
Figure 4:
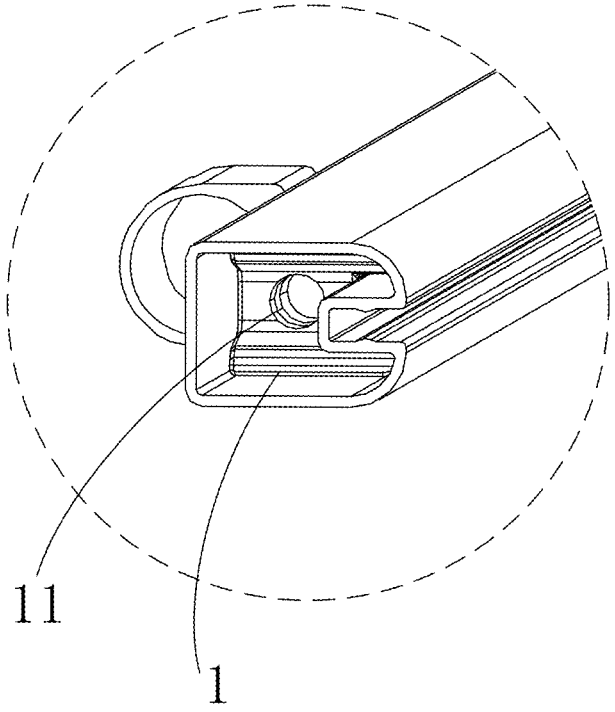
FIG. 4 is a schematic structural enlarged view of part A according to an embodiment of the present disclosure.
Figure 5:
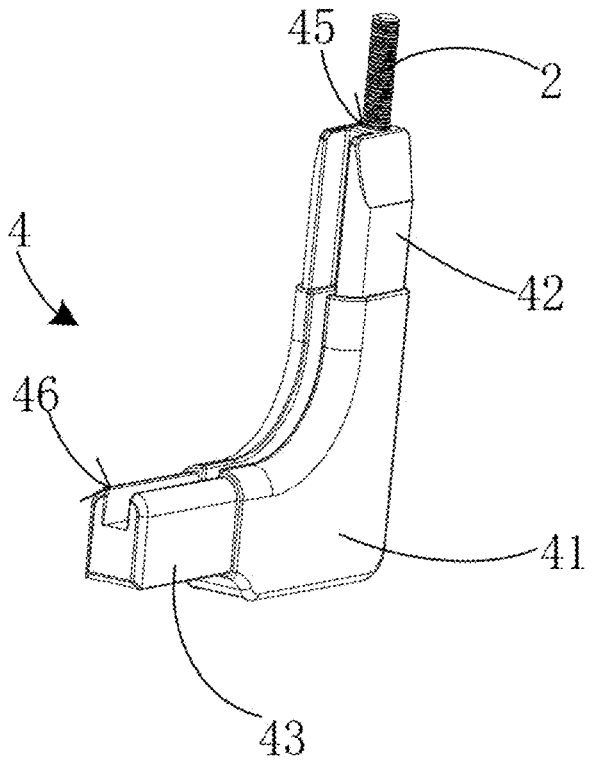
FIG. 5 is a schematic structural diagram of a supporting foot according to an embodiment of the present disclosure.
Figure 6:
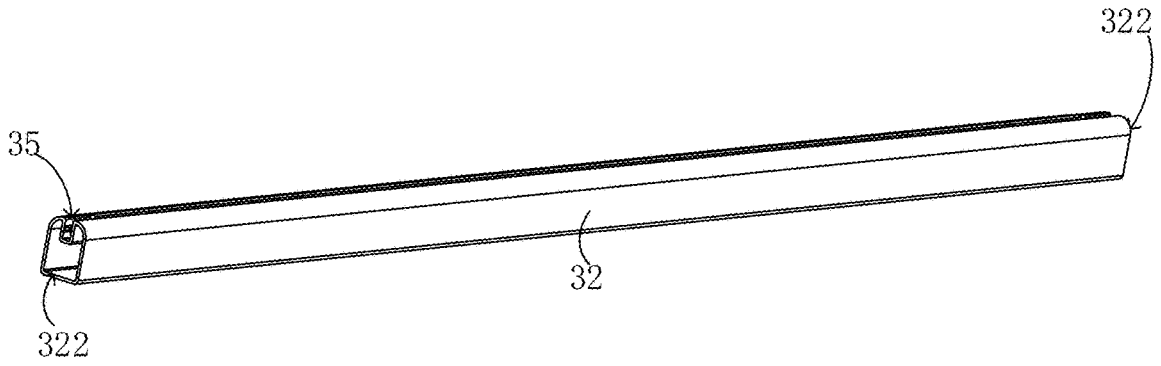
FIG. 6 is a schematic structural diagram of a bottom transverse tube according to an embodiment of the present disclosure.

With reference to FIGS. 1 to 3, in one of the embodiments, the frame 3 further includes a connecting member 34, and two ends of the connecting member 34 are inserted into the top transverse tube 33 and the longitudinal tube 31 respectively to connect the top transverse tube 33 and the longitudinal tube 31. Specifically, one of ports of the top transverse tube 33 matches one end of the connecting member 34, and one end of the connecting member 34 can be inserted into the port; and a port, facing the top transverse tube 33, of the longitudinal tube 31 matches the other end of the connecting member 34, and the other end of the connecting member 34 can be inserted into the port of the longitudinal tube 31, such that the longitudinal tube 31 can be mounted on one of the ends of the top transverse tube 33. Similarly, a further longitudinal tube 31 can be mounted on the other end of the top transverse tube 33 by means of a further connecting member 34, which will not be described in detail herein. The connecting member 34 is then further secured to the top transverse tube 33 and the longitudinal tube 31 in a riveting manner. The above insertion method for the connecting member 34 is simple and efficient, and does not need a complex tooling operation. The riveting method is conducive to improving the connection strength of the frame 3 and ensuring the stability of the fence during long-term use. In some embodiments, the connecting member 34 and the top transverse tube 33 are further secured by means of a fixing pin. The connecting member 34 and the longitudinal tube 31 are further secured by means of a fixing pin.

With reference to FIGS. 1 to 3, the connecting member 34 may be made of a plastic or metal material. The frame 3 is made of the metal material, for example, an aluminum alloy. The second fastener 2 is made of the metal material, for example, an iron nail. The face plate 5 is an acrylic plate.

With reference to FIGS. 1 to 3, in one of the embodiments, an anti-slip pad 44 is disposed on a side, facing the floor, of the supporting end 41. The second fastener 2 is securely connected to the first fastener 1 by passing through the anti-slip pad 44, the supporting end 41 and the connecting end 42 in sequence, thereby mounting the anti-slip pad 44 to the supporting end 41. As the anti-slip pad 44 is disposed at the bottom of the supporting foot 4, an anti-slip function is provided for an entire structure, and meanwhile the anti-slip pad 44 can effectively prevent the friction between the fence and the floor and reduce wear and noise, which are beneficial to protecting the floor and the supporting foot 4 and improving the user experience.

It should be understood that the anti-slip pad 44 may also be fixed to the bottom of the supporting foot 4 by other means, for example, adhesion or welding. A silicone pad may be used as the anti-slip pad 44.

The mounting steps of the present disclosure are as follows: (1) the longitudinal tube 31, the connecting member 34 and the top transverse tube 33 are first mounted and secured; (2) the face plate 5 is mounted; (3) the supporting foot 4 and the bottom transverse tube 32 are mounted and secured; (4) the second fastener 2 and the first fastener 1 are screwed and fastened; (5) the second fastener 2 passes through the anti-slip pad 44, the supporting end 41 and the connecting end 42 in sequence, and is aligned to the first fastener 1; when the second fastener 2 is the screw, the first fastener 1 and the second fastener 2 are screwed with a tool, such that the first fastener 1 and the supporting foot 4 press against each other to form a tight fit, and the anti-slip pad 44 is concurrently locked at the bottom of the supporting foot 4. The above mounting steps are simple and easy for the user to operate.

With reference to FIGS. 1 to 3, the present disclosure further provides a fence, which includes a plurality of fence panels 100, adjacent fence panels 100 are articulated, and a plurality of fence panels 100 enclose an area for animal activity. The fence is assembled only by means of articulation and the like, without a complex welding process, and is simple and easy to mount.

The above technical solution has at least the following advantages or beneficial effects:

In the present disclosure, as the first fastener 1 is disposed in the longitudinal tube 31 and then the second fastener 2 is securely connected to the first fastener 1 by passing through the supporting foot 4, a better effect of securing the supporting foot 4 and the longitudinal tube 31 is achieved, and the frame 3 is firmly secured to the supporting feet 4; moreover, the mounting steps are simple and easy for the user to operate.

The first fastener 1 is embedded into the longitudinal tube 31, so that the first fastener 1 can be protected from being affected by an external environment, and the appearance tidiness can also be improved.

As the anti-slip pad 44 is disposed at the bottom of the supporting foot 4, an anti-slip function is provided for an entire structure, and meanwhile the anti-slip pad 44 can effectively prevent the friction between the fence and the floor and reduce wear and noise, which are beneficial to protecting the floor and the supporting foot 4 and improving the user experience.

In the description of this specification, expressions with reference to the terms such as "an embodiment", "some embodiments", "example", "specific example", or "some examples" mean that specific features, structures, materials, or characteristics described with reference to the embodiment or example are included in at least one embodiment or example of the present disclosure. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are merely used for the purpose of illustration, and cannot be construed as indicating or implying relative importance or implicitly indicating the number of technical features indicated. Thus, the features defined with "first" and "second" may explicitly or implicitly include at least one of the features. In the description of the present disclosure, the meaning of "a plurality of" is two or more, unless explicitly and specifically defined otherwise.

The above description is merely specific implementations of the present disclosure, but is not intended to limit the scope of protection of the present disclosure. Any variation or replacement readily figured out by a person skilled in the art within the technical scope disclosed in the present disclosure shall fall within the scope of protection of the present disclosure. Therefore, the scope of protection of the present disclosure shall be subject to the scope of protection of the claims.

What is claimed is:

1. A fence panel, comprising:

a frame, the frame comprising:

a longitudinal tube;

a top transverse tube; and a bottom transverse tube disposed opposite to the top transverse tube in a vertical direction, wherein catch slots are respectively formed in two ends of the bottom transverse tube;

a first fastener embedded into an end of the longitudinal tube;

a second fastener configured to cooperate with the first fastener;

a supporting foot configured to connect the longitudinal tube and the bottom transverse tube, the supporting foot comprising a supporting end, and a connecting end and a snap-in post disposed on the supporting end, the supporting end being configured to contact with a floor, the connecting end being inserted into the end of the longitudinal tube provided with the first fastener, the supporting foot further being internally provided with a through hole running through the supporting end and the connecting end, the second fastener being disposed in the through hole and protruding out of the supporting foot, and the snap-in post being configured to be inserted into the catch slot and engaged therewith;

a connecting member, two ends of the connecting member being respectively inserted into the top transverse tube and the longitudinal tube to connect the top transverse tube and the longitudinal tube;

a face plate completely filling an area enclosed by the frame;

wherein the bottom transverse tube, the top transverse tube, and the longitudinal tube are each provided with an elongated groove along respective length directions thereof, an edge of the face plate is inserted into the elongated groove, the supporting foot is provided with an arc-shaped groove on a side facing the face plate, and a corner edge of the face plate is inserted into the arc-shaped groove, so as to embed the face plate into the frame.

2. The fence panel according to claim 1, wherein an inner wall of the first fastener is provided with a thread configured to cooperate with the second fastener, the second fastener is a screw, and the screw engages with the thread.

3. The fence panel according to claim 1, wherein one end of the top transverse tube is connected to a corresponding end of the bottom transverse tube by means of one of the longitudinal tubes, and the other end of the top transverse tube is connected to a corresponding other end of the bottom transverse tube by means of the other of the longitudinal tubes.

4. The fence panel according to claim 1, wherein an anti-slip pad is disposed on a side, facing the floor, of the supporting end.

5. The fence panel according to claim 4, wherein the second fastener is securely connected to the first fastener by passing through the anti-slip pad, the supporting end and the connecting end in sequence, thereby mounting the anti-slip pad to the supporting end.

6. The fence panel according to claim 4, wherein the anti-slip pad is a silicone pad.

7. A fence, comprising a plurality of fence panels, adjacent fence panels being connected in an articulated manner;

wherein the fence panel comprises:

a frame, the frame comprising:

a longitudinal tube;

a top transverse tube; and a bottom transverse tube disposed opposite to the top transverse tube in a vertical direction, wherein catch slots are respectively formed in two ends of the bottom transverse tube;

a first fastener embedded into an end of the longitudinal tube;

a second fastener configured to cooperate with the first fastener;

a supporting foot configured to connect the longitudinal tube and the bottom transverse tube, the supporting foot comprising a supporting end, and a connecting end and a snap-in post disposed on the supporting end, the supporting end being configured to contact with a floor, the connecting end being inserted into the end of the longitudinal tube provided with the first fastener, the supporting foot further being internally provided with a through hole running through the supporting end and the connecting end, the second fastener being disposed in the through hole and protruding out of the supporting foot, and the snap-in post being configured to be inserted into the catch slot and engaged therewith;

a connecting member, two ends of the connecting member being respectively inserted into the top transverse tube and the longitudinal tube to connect the top transverse tube and the longitudinal tube;

a face plate completely filling an area enclosed by the frame;

wherein the bottom transverse tube, the top transverse tube, and the longitudinal tube are each provided with an elongated groove along respective length directions thereof, an edge of the face plate is inserted into the elongated groove, the supporting foot is provided with an arc-shaped groove on a side facing the face plate, and a corner edge of the face plate is inserted into the arc-shaped groove, so as to embed the face plate into the frame.

8. The fence according to claim 7, wherein an inner wall of the first fastener is provided with a thread configured to cooperate with the second fastener, the second fastener is a screw, and the screw engages with the thread.

9. The fence according to claim 7, wherein one end of the top transverse tube is connected to a corresponding end of the bottom transverse tube by means of one of the longitudinal tubes, and the other end of the top transverse tube is connected to a corresponding other end of the bottom transverse tube by means of the other of the longitudinal tubes.

10. The fence according to claim 7, wherein an anti-slip pad is disposed on a side, facing the floor, of the supporting end.

11. The fence according to claim 10, wherein the second fastener is securely connected to the first fastener by passing through the anti-slip pad, the supporting end and the connecting end in sequence, thereby mounting the anti-slip pad to the supporting end.

12. The fence according to claim 10, wherein the anti-slip pad is a silicone pad.

* * * * *